US006314901B1

(12) United States Patent
Smedal

(10) Patent No.: US 6,314,901 B1
(45) Date of Patent: Nov. 13, 2001

(54) METHOD AND AN ARRANGEMENT FOR MOORING OF A SHIP, PARTICULARLY A SHIP FOR OIL AND/OR GAS PRODUCTION

(75) Inventor: Arne Smedal, Stavanger (NO)

(73) Assignee: Hitec Systems AS, Forus (NO)

( * ) Notice: Subject to any disclaimer, the term of this patent is extended or adjusted under 35 U.S.C. 154(b) by 0 days.

(21) Appl. No.: 09/529,088

(22) PCT Filed: Oct. 7, 1998

(86) PCT No.: PCT/NO98/00303

§ 371 Date: Aug. 16, 2000

§ 102(e) Date: Aug. 16, 2000

(87) PCT Pub. No.: WO99/17982

PCT Pub. Date: Apr. 15, 1999

(30) Foreign Application Priority Data

Oct. 8, 1997 (NO) ..... 974639

(51) Int. Cl.[7] ..... B63B 21/50
(52) U.S. Cl. ..... 114/230.12; 114/293
(58) Field of Search ..... 114/293, 230.12, 114/144 B, 230.1; 441/3–5

(56) References Cited

U.S. PATENT DOCUMENTS 3,191,201 * 6/1965 Richardson et al. ..... 441/3
3,583,354 6/1971 Flickinger .
3,774,562 * 11/1973 Dean, III ..... 114/293
4,566,398 1/1986 Sasaki et al. .
5,359,957 11/1994 Asketsad .
5,381,750 1/1995 Pollack .

FOREIGN PATENT DOCUMENTS 60-146787 * 8/1985 (JP) ..... 114/293
86/02329 4/1986 (WO) .
96/26861 9/1996 (WO) .

* cited by examiner

*Primary Examiner*—Sherman Basinger
(74) *Attorney, Agent, or Firm*—Andrus, Sceales, Starke & Sawall, LLP

(57) ABSTRACT

When mooring a production ship (10) above a submarine production well, minimum three (usually e.g. eight) anchor lines are used in the form of mooring chains (16*b*, 16*a'*, 16*b'*, 16*c'*) each extending from a stationary point at the seabed to a separate attachment point on the ship (10). At least one anchor line (16*b*, 16*c*) (of a minimum line number of three) has a fixed length and leads to an attachment hook (20) on-board the ship, while the or each of the remaining anchor lines (16*a'*, 16*c'*, 16*d'*), as known per se, has a changeable, shortenable length between the stationary seabed point and a point (34) on the ship (10), e.g. by means of a winch (30) for each of said longitudinally changeable anchor lines (16*a'*, 16*c'*, 16*d'*), simplifying the mooring arrangement constructively and the mooring operations functionally.

5 Claims, 6 Drawing Sheets

METHOD AND AN ARRANGEMENT FOR MOORING OF A SHIP, PARTICULARLY A SHIP FOR OIL AND/OR GAS PRODUCTION

BACKGROUND OF THE INVENTION

The present invention relates to a method for mooring a ship, in the open sea, especially an oil/gas production ship positioned above a submarine well, comprising three or more mooring chains/anchor lines extending from a turret disposed within the ship to anchors/anchoring points on the seabed.

Likewise, the invention relates to a mooring arrangement based on the use of said three or more mooring chains/anchor lines, and aims at achieving considerable simplifications and improvements in or indirectly relating to said turret, said simplifications manifesting themselves in significant savings, both economical and operational upon the establishment of the mooring.

Said turret has been disposed in association with a vertically through-going cavity in the ship, said cavity being formed i.a. for passage of a production riser string and/or other production accessory and, possibly, for the accommodation and temporarily attachment of a so-called STL buoy. The turret which has a substantially vertical axis, is freely rotatably mounted in the ship, for relative turning around said axis, so that the ship may turn dependent on wind and current conditions about the axis of the turret. The turret will be equipped with at least one pipeline portion which is connected to an underlying portion and which, uppermost, through a swivel device, is connected to a pipeline connected to the ship and may lead to its storage room for oil.

It is previously known to moor such a production ship to the seabed, so that it may turn about the axis of the turret.

First, according to previously known technique of this kind, e.g. eight anchor lines in the form of mooring chains or wires are positioned on the seabed and attached thereto through anchors or through other fastening by means of piles or the like, in order to, thereupon, to be drawn up via the free end portion through the turret. In known turrets of this kind, lowermost in the turret, is for each mooring chain disposed a rotary guide pulley which, normally, will be situated below the sea surface and, therefore, represents a considerable maintenance problem. For each anchor line, besides the guide pulley, at a higher situated level, a separate winch has been disposed, i.e. totally eight individual winches, each with a guide pulley assigned thereto. The winches serves to stretch and tension the individual mooring chain associated therewith, and these chains are locked in the tightened condition thereof.

This known mooring arrangement is expensive in purchase and operation, and it is relatively awkward in use.

SUMMARY OF THE INVENTION

The object of the invention has primarily been to simplify the mooring arrangement purely constructively and also such that the necessary number of mooring chains/anchor lines may be brought into active, stretched, tensioned and locked condition in a way only implying winch-based tightening of some of the mooring chains/anchor lines.

For the method, said object has been realized by proceeding in accordance with the steps/operations as defined in the claims.

The mooring arrangement distinguishes itself through con5 structive detail features as appearing from the following claims.

When one is in the process of mooring a production ship to the seabed through the turret of the ship, so that the ship will become positioned substantially on the upward vertical projection of an underlying production well, the mooring chains have been placed on the seabed beforehand as well as anchored thereto at their one ends, the mooring chains/anchor lines having such a length that they in stretched, tightened, tensioned and locked condition will centre the turret and, thus, the ship above the production well.

According to the present invention, the turret, preferably at a lower portion, is equipped with hooks or other fasteners or attachment means for half the number of mooring chains of the total number, i.e. four hooks/fasteners in the exemplary case concerned. If in all three mooring chains are used only, one or two of these chains may be assigned thereto a fixed attachment means.

In conformity with the method according to the invention, each of these so-called 'fixed' anchor lines, possibly after the turret has been raised somewhat by means of a hoisting means so that the hooks/fasteners are exposed, is attached to a hook/fastener, whereupon the turret possibly can be lowered, each of the remaining mooring chains, as known per se, thereupon being connected with the winch belonging thereto, to carry out the final stretching/tensioning. When the mooring chains each tightened by means of its own winch are taut, the production ship is correctly positioned, simultaneously as the mooring arrangement then is correctly biased.

Upon the tightening of the "movable" anchor lines by means of a separate winch for each line, or by means of one common, displaceable winch, the stretching operations are made diametrically in relation to the opposedly positioned "fixed" anchor line.

In the method and in the mooring arrangement according to the invention, the mooring chains not assigned any winch beforehand, are allotted a fixed length between the anchoring point on the seabed and the turret. The remaining mooring chains assigned a winch have a changeable length. The last-mentioned mooring chains will have a length which will be oversized in relation to the active length, the respective winch being adapted to accommodate surplus chain length in the final position thereof. These anchor lines having adjustable length are each tightened and tensioned by means of the winches until also the anchor lines having fixed length are correctly stretched. Thereupon, the anchor lines can be locked as known per se, e.g. by means of locking devices carried by the turret.

BRIEF DESCRIPTION OF THE SEVERAL VIEWS OF THE DRAWINGS

A non-restricting exemplary embodiment of a mooring method and arrangement is further explained in the following, reference being made to the accompanying drawings, in which.

DETAILED DESCRIPTION OF THE INVENTION

Figure 1:
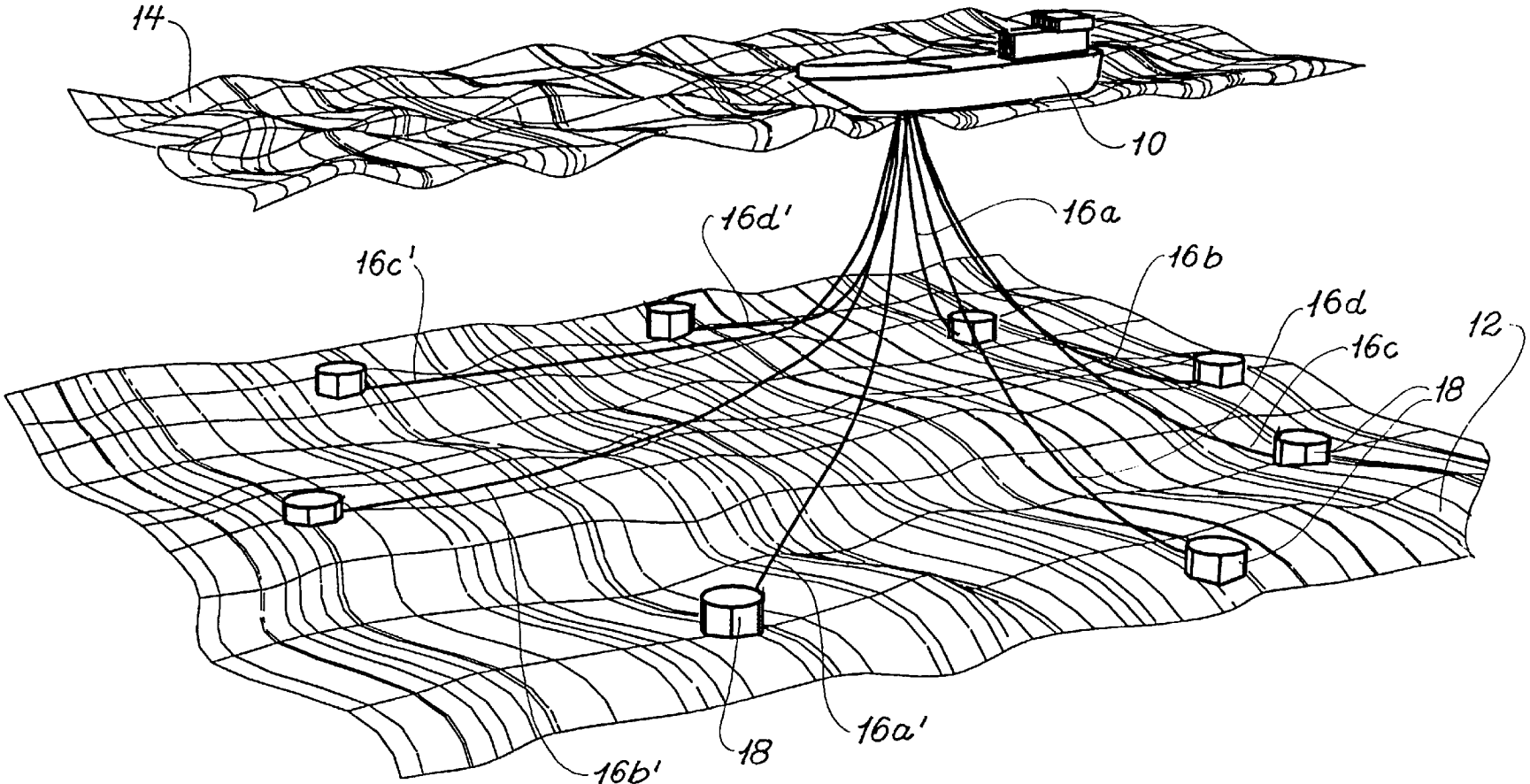
FIG. 1 shows a simplified, diagrammatical perspective view of a production ship in the process of being positioned above a production well, prior to eight mooring chains have been subjected to setting-up and stretching/tensioning.

In the drawings, reference numeral 10 denotes a production ship. It is desired that this ship is moored with rotatability in relation to wind/current conditions and, wherein, on the seabed 12 at least one not shown production well is pres ent, in relation to which the production ship 10 is to be positioned. The sea surface is denoted at 14.

In the exemplary embodiment shown, the production ship 10 is to be moored by means of eight anchor lines in the form of mooring chains 16*a*, 16*b*, 16*c*, 16*d*, 16*a*', 16*b*', 16*c*' and 16*d*' each leading to a beforehandly placed anchor/mooring point 18 on the seabed 12.

Figure 4:
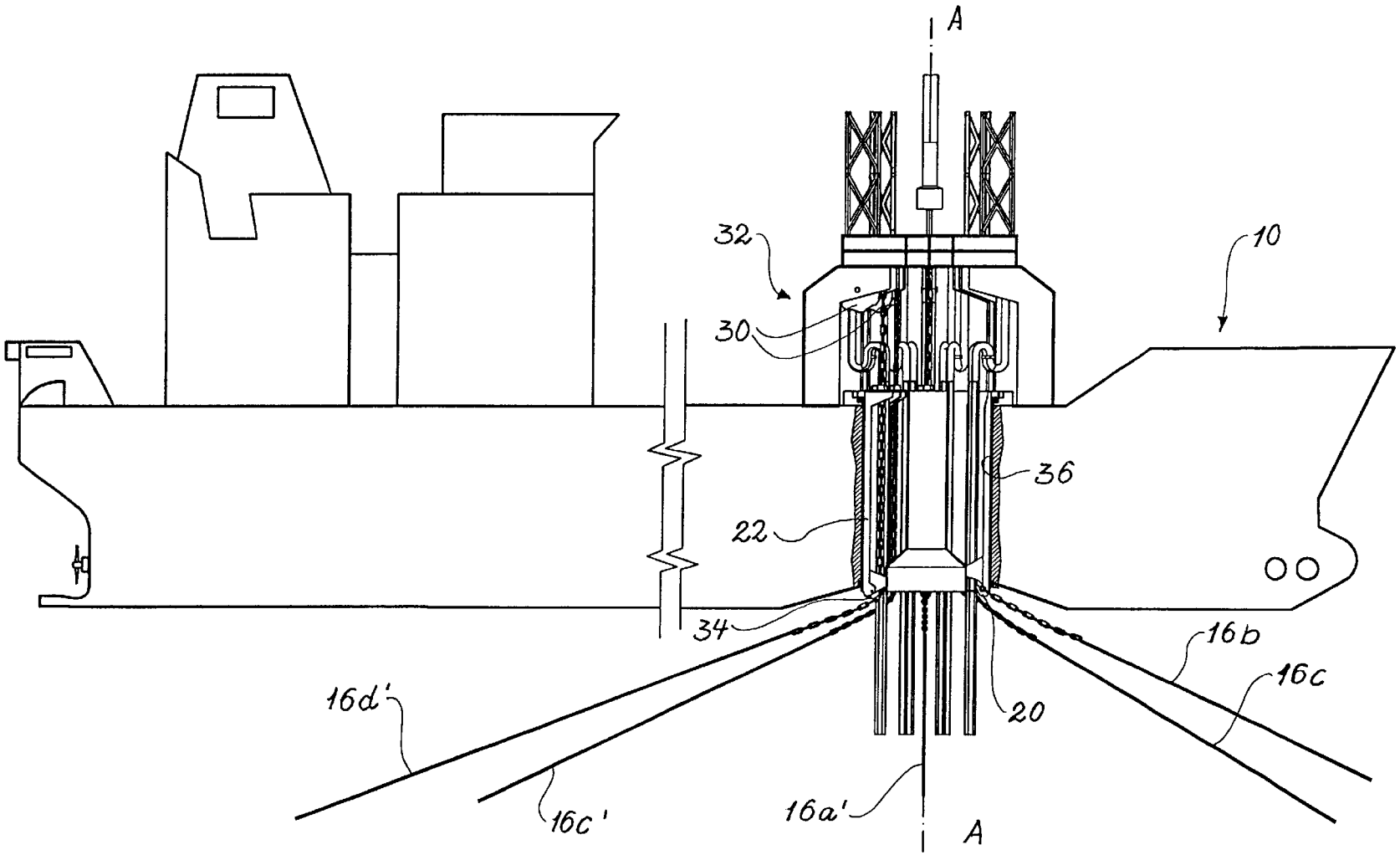
FIG. 4 shows a production ship in side elevational view and cut through in the area of a vertically through-going cavity (shaft) and a turret disposed with a vertical axis in said cavity and being relatively freely rotatably mounted to the ship's hull.
Figure 5:
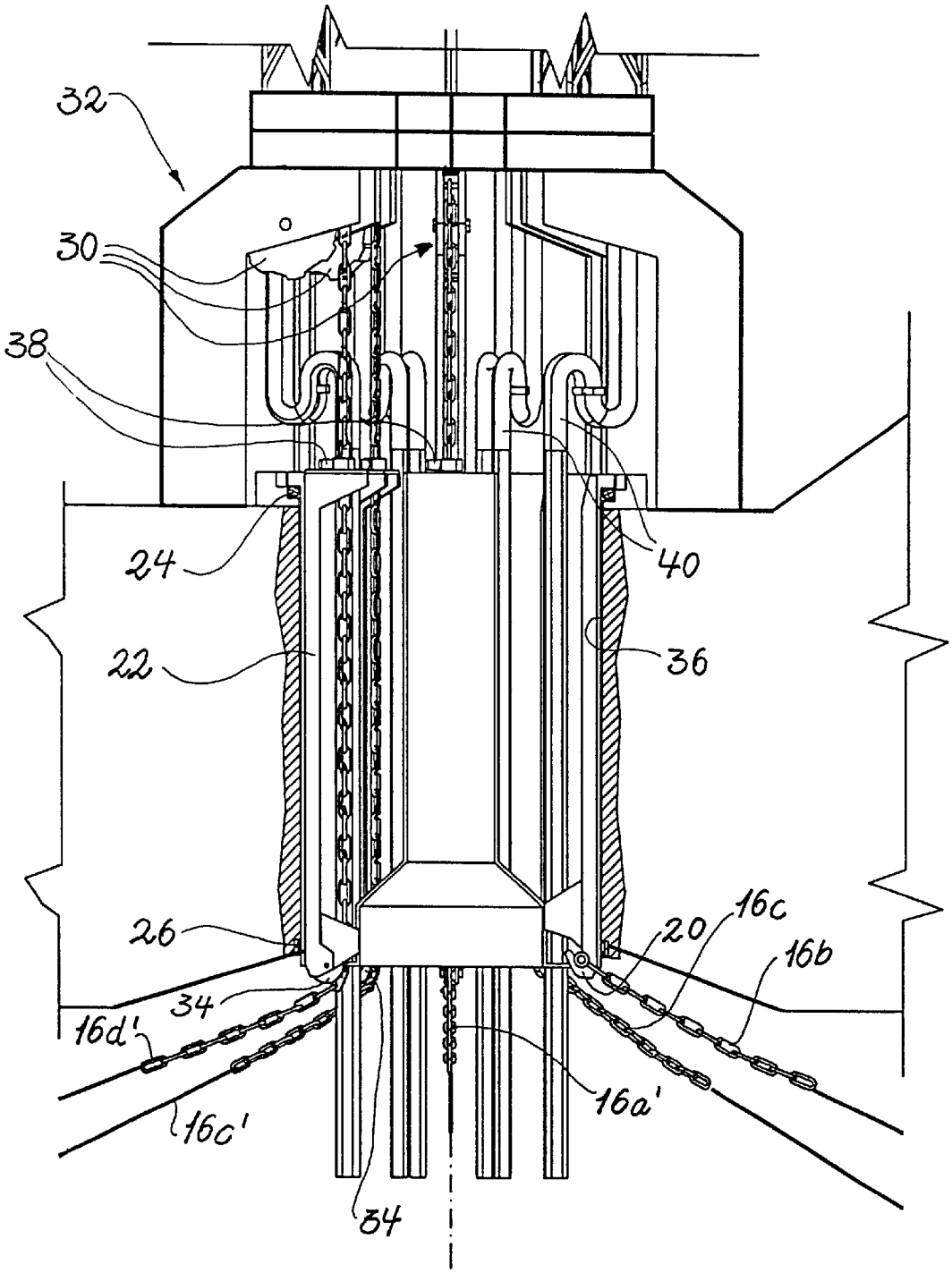
FIG. 5 shows, on a larger scale than in FIG. 4, the mounting of the turret within said vertically through-going cavity as well as the overlying rig, from which the winches have been suspended, and wherein the hooks or fasteners of suspension for the "fixed" anchor lines appear and, likewise, the rotary guiding discs or pulleys of the movable anchor lines, approximately at the same level as the hooks.
Figure 6:
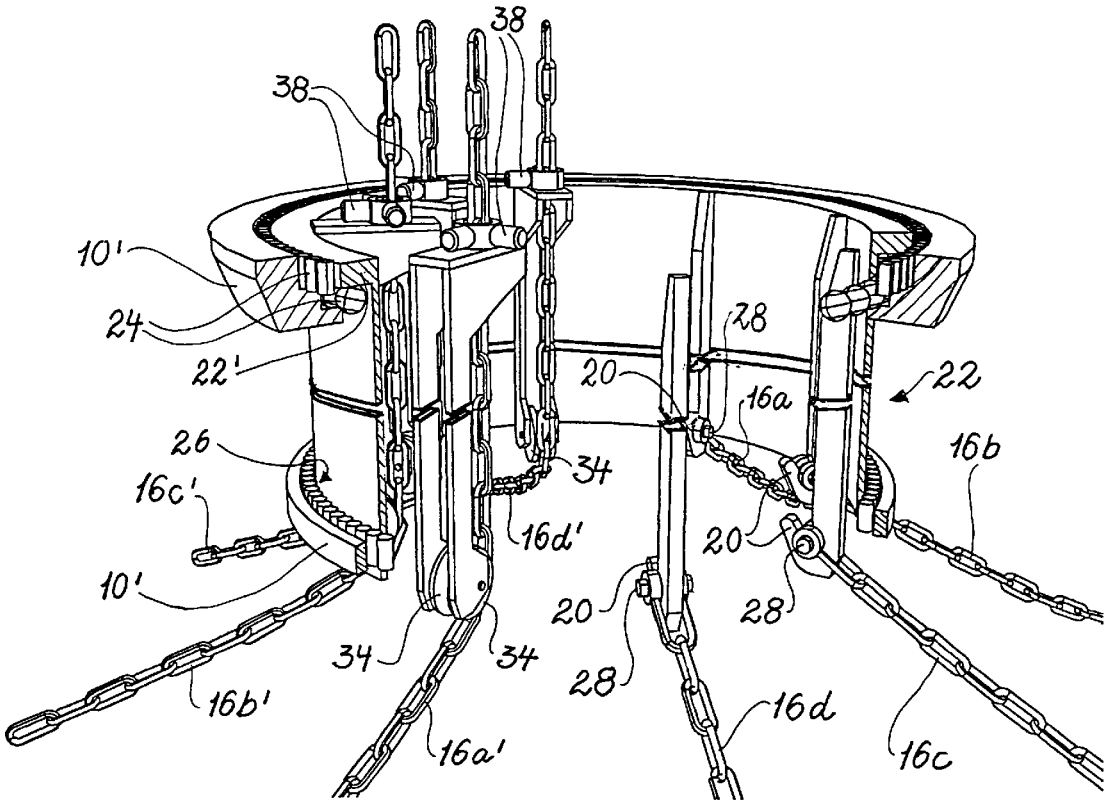
FIG. 6 is a perspective view of the turret and its rotary mounting within the ship's hull, the turret in this figure, where the scale is larger than in the remaining figures, has been shortened by division.

According to the exemplary embodiment, four mutually adjacent mooring chains 16*a*, 16*b*, 16*c*, 16*d* each has a fixed length extending from the respective anchor 18 to an attachment hook 20 fastened to a turret 22, FIGS. 4–6, disposed rela tively rotatably in relation to the ship 10.

The turret 22 is raisable/lowerable for temporarily to expose underlying structure, and it is provided with a vertically through-going cavity for lowering/hoisting a production riser string (not shown) as known per se. According to FIG. 6, between adjacent ship's hull portion 10' and the turret 22, an upper combined roller/ball bearing 24 and a lower roller bearing 26, wherein the rollers in both cases have vertical rotational axes, the bearing balls being disposed below a radially projecting ring flange portion 22' of the turret 22. If desirable, the turret 22,22' may then be raised from the position shown in FIG. 6 in order to expose the attachment hooks 20 for the mooring chains 16*a*, 16*b*, 16*c* and 16*d* each having a fixed length, and lowered back to the position shown whenever the chains 16*a*–16*d* have been suspended from the hooks 20 through a lateral bolt 28 fastened to the upper chain link.

The remaining four anchor lines/mooring chains 16*a*', 16*b*', 16*c*' and 16*d*' each consists of shortenable chains and, to this end, each of them is, preferably, connected to an individual winch 30 suspended from a rig structure 32 at a higher level than the top of the turret 22, by means of its own rotary guide pulley 34 positioned at approximately the same level as the attachment hooks 20 for the anchor lines 16*a*–16*d* having fixed length.

Pipelines extending within the turret 22, either centrically or along the periphery such as the pipes 40, FIG. 5, are exclusively associated with production risers and with pipes on board the ship connectable thereto. However, the present invention relates merely to the way of mooring and the mooring arrangement for such a production ship, and, therefore, the positioning of these production tubings has not been further described. The turret 22 is placed within a throughgoing cavity 36 through the ship 10.

Figure 2:
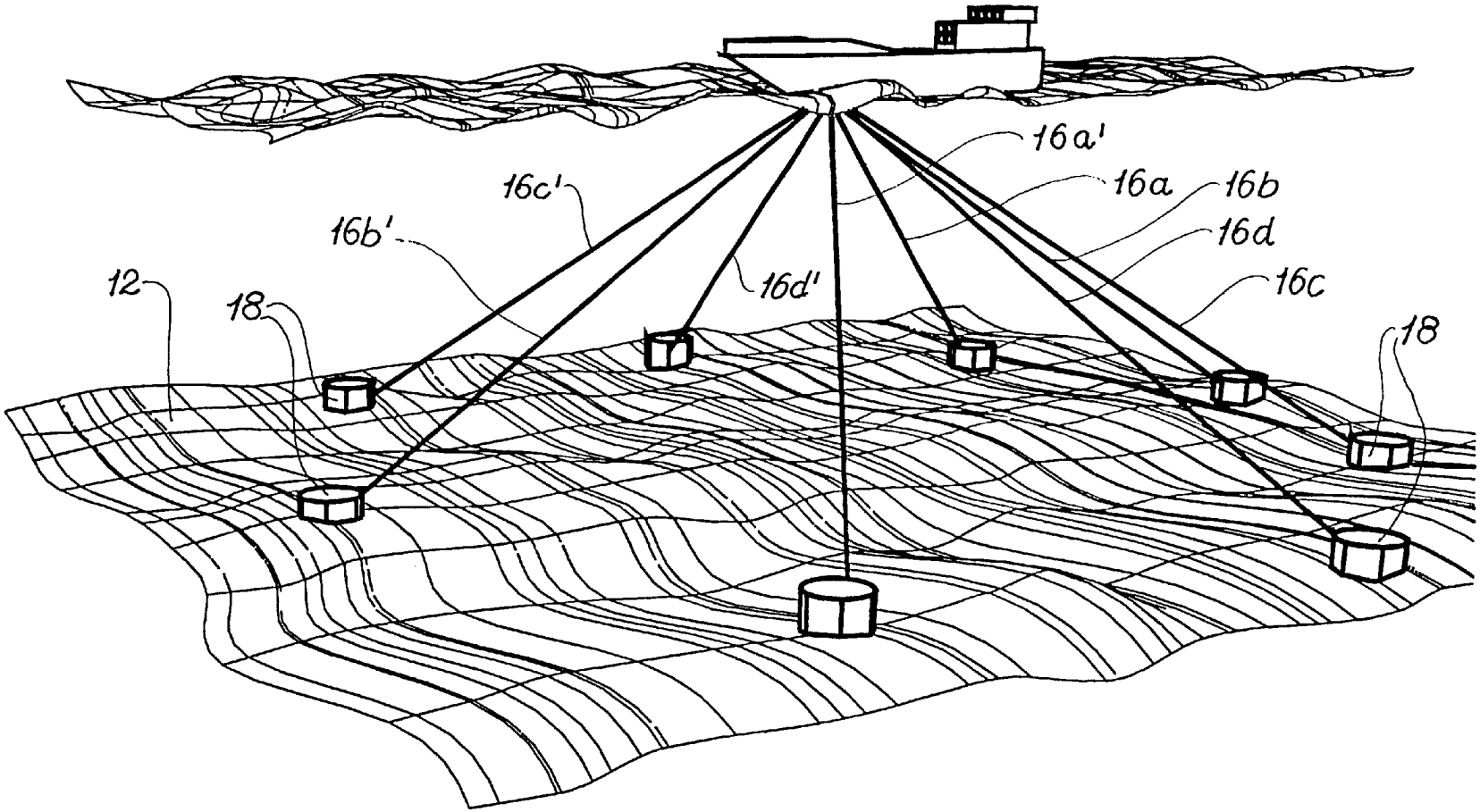
FIG. 2 shows the same as in FIG. 1, but here all mooring chins/anchor lines have been set up and tightened; the stretching in FIG. 2, for illustrative purposes, being shown in the form of a rectilinear chain course, not representing practical conditions, where the anchor line would sag a little.
Figure 3:
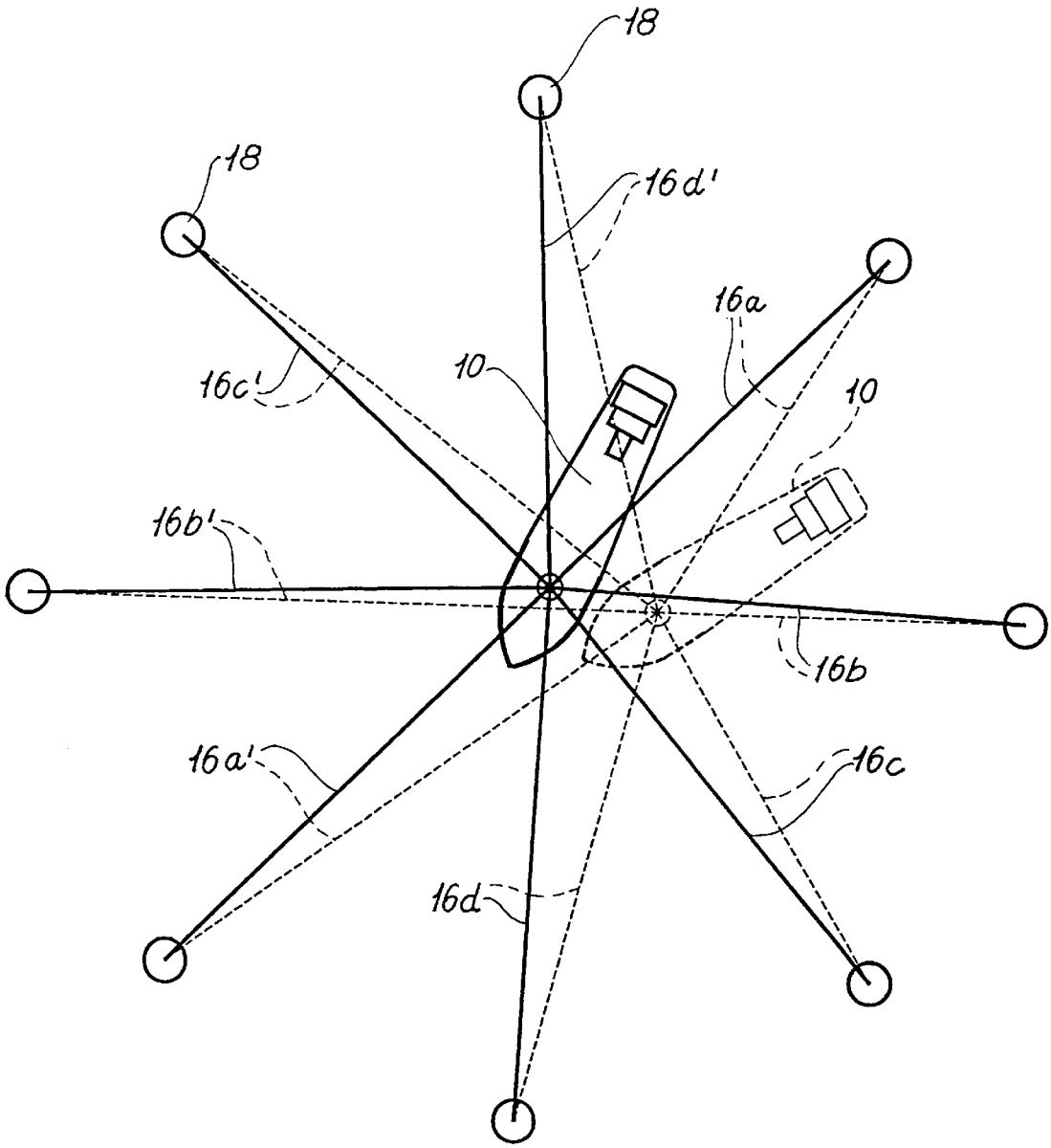
FIG. 3 is a top plan view where dotted lines show the ship's/turret's position and the course of the mooring chains before their setting-up and stretching. The ship may have moved somewhat by its own machine in order to tighten the anchor lines having fixed length before the anchor lines having individually changeable length is set up and stretched by means of the winches, whereupon the position of the ship/turret and the course of the anchor lines, for illustrative purposes, would be as shown in solid lines.

Again, reference is made to FIGS. 1–3: The basis for FIG. 1 is that all mooring chains 16*a*–16*d* and 16*a*'–16*d*' are in untightened condition.

In order to stretch and tension the mooring chain 16*a*–16*d* having individually fixed length from the respective attachment hook 20 to the anchor 18 on the seabed 12, the longitudinal changeable chains 16*a*'–16*d*' are tightened diametrically in relation to the longitudinally unchangeable chains 16*a*–16*d*, i.e. the chain 16*a*' is tightened by means of the winch 30, simultaneously retightening the chain 16*a* and so forth.

FIG. 2 shows the mooring arrangement wherein all chains 16*a*–16*d*, 16*a*–16*d*' have been stretched and tensioned, and wherein each of the winch-assigned chains 16*a*'–16*d*' has been locked, e.g. by inserting a displaceable pin of a locking device 38 for each chain lockingly into a proximate chain link and securing it from being pulled out.

What is claimed is:

1. A method for mooring an oil production ship in a relation to a seabed oil production well, the ship having a turret which, in the moored condition of the oil production ship, allows the ship to rotate about a vertical axis of the turret responsive to wind and sea current conditions, said method comprising the steps of:

securing a first end of each of at least three anchor lines to the seabed, the first ends being secured at points that are circumferentially spaced from each other on the seabed around the oil production well;

selecting at least one of the anchor lines but less than all of the anchor lines as a fixed length anchor line;

connecting a second end of the at least one selected anchor line to a fastener on the turret to establish the fixed length of the anchor line;

connecting the second end of each of the remaining anchor lines to a winch by which the length of the respective anchor line connected thereto may be adjusted, the winches to which the second ends of each of the adjustable length anchor lines are connected being separate from each other and being located with respect to the turret such that adjusting the length of the remaining anchor lines will alter the amount of tightness in the at least one fixed length anchor line, and adjusting the length of the remaining anchor lines with the winches to reduce their length and cause tightening of the at least one fixed length anchor line and moor the oil production ship in the relation to the oil production well.

2. A method as defined in claim 1 further including the step of locking the adjustable length anchor lines to the turret after adjusting the length of the adjustable length anchor lines.

3. Apparatus for mooring an oil production ship in relation to a seabed oil production well, said apparatus comprising:

at least three anchor lines, first ends of said anchor lines being secured to points on the seabed that are circumferentially spaced from each other around the oil production well;

a turret in the ship around which, in the moored condition of the ship, the ship can rotate responsive to wind and sea current conditions;

fastener means on said turret for connecting a second end of at least one of said anchor lines but less than all of said anchor lines to said turret to form said at least one anchor line into an anchor line of fixed length;

winch means mounted on said turret for receiving the remainder of said anchor lines, said winch means comprising separate winches, each engaging one of said remaining anchor lines for adjusting the length of the respective anchor line to form an anchor line of adjustable length, said winches being disposed on said turret such that adjusting the length of said remaining anchor lines will alter the amount of tightness in said at least one fixed length anchor line to moor the oil production ship in relation to the oil production well.

4. Apparatus as defined in claim 3 further including locking means for locking said adjustable length mooring lines to said turret.

5. Apparatus as defined in claim 3 further including a guiding and deflecting pulley mounted on said turret for each of said adjustable length anchor lines, said pulleys forming contact points between said turret and the respective anchor line co-operating therewith.

* * * * *